US008101120B2

(12) United States Patent
Juhl

(10) Patent No.: US 8,101,120 B2
(45) Date of Patent: Jan. 24, 2012

(54) METHOD FOR THE HEAT TREATMENT OF A PROFILE, DEVICE FOR THE HEAT TREATMENT OF A PROFILE AND PROFILE

(75) Inventor: Knut Juhl, Bremen (DE)

(73) Assignee: Airbus Deutschland GmbH (DE)

( * ) Notice: Subject to any disclaimer, the term of this patent is extended or adjusted under 35 U.S.C. 154(b) by 0 days.

(21) Appl. No.: 12/226,231

(22) PCT Filed: Apr. 13, 2006

(86) PCT No.: PCT/EP2006/003442

§ 371 (c)(1),
(2), (4) Date: Oct. 8, 2008

(87) PCT Pub. No.: WO2007/118489

PCT Pub. Date: Oct. 25, 2007

(65) Prior Publication Data

US 2009/0165900 A1 Jul. 2, 2009

(51) Int. Cl.
*C21D 9/00* (2006.01)

(52) U.S. Cl. ..... 266/249; 138/128; 138/156; 219/428; 266/251; 266/252; 266/255; 266/258; 432/207

(58) Field of Classification Search ..... 138/128, 138/156–169; 219/428, 528; 266/255, 258, 266/249, 251, 252; 432/207, 208; 428/36.9, 428/36.91, 188

See application file for complete search history.

(56) References Cited

U.S. PATENT DOCUMENTS 2,574,564 A 11/1951 Hogel et al.
3,794,531 A 2/1974 Marworth et al.
4,682,011 A 7/1987 Hoffmann et al.
5,052,923 A 10/1991 Peter et al.
5,277,227 A * 1/1994 Bradshaw et al. ..... 138/110
5,527,020 A * 6/1996 Ganesh et al. ..... 266/260
5,858,134 A 1/1999 Bechet et al.
5,967,194 A * 10/1999 Martin ..... 138/156
6,027,582 A 2/2000 Shahani et al.
6,185,976 B1 2/2001 Moser et al.

(Continued)

FOREIGN PATENT DOCUMENTS

DE 962708 5/1957

(Continued)

OTHER PUBLICATIONS

International Search Report, PCT/EP2006/003442.

(Continued)

*Primary Examiner* — Stanley Silverman
*Assistant Examiner* — Brian Walck
(74) *Attorney, Agent, or Firm* — Lerner, David, Littenberg, Krumholz & Mentlik, LLP

(57) ABSTRACT

A method and device for the heat treatment of a profile, in particular an extruded profile for aircraft. The profile may be formed by one or more different, in particular curable, aluminium alloys. The method provides that at least two regions of a profile are subjected to a different heat treatment. The device includes a first chamber that encloses a first region of a profile and a second chamber that encloses a second region of the profile, wherein different temperatures can be set in the first and second chambers. The profile has at least two regions that each have different material properties and are formed by differential heat treatment.

7 Claims, 2 Drawing Sheets

U.S. PATENT DOCUMENTS

| | | | | |
|---|---|---|---|---|
| 6,752,885 | B1 | 6/2004 | Jerichow | |
| 2002/0150498 | A1 | 10/2002 | Chakrabarti et al. | |
| 2004/0112485 | A1* | 6/2004 | Reinhold et al. | 148/639 |

FOREIGN PATENT DOCUMENTS

| | | | |
|---|---|---|---|
| DE | 1180536 | | 10/1964 |
| DE | 2052000 | C | 4/1972 |
| DE | 3313651 | | 10/1984 |
| DE | 3934103 | | 4/1991 |
| DE | 69502508 | T2 | 10/1994 |
| DE | 19645227 | | 5/1998 |
| DE | 10043562 | | 3/2001 |
| DE | 10002021 | | 4/2001 |
| EP | 0422353 | | 4/1991 |
| EP | 0839681 | | 5/1998 |
| JP | 59200715 | A | 11/1984 |
| RU | 2094161 | C1 | 10/1997 |
| RU | 2216420 | C2 | 11/2003 |
| SU | 621795 | A1 | 8/1978 |
| SU | 916806 | A1 | 3/1982 |
| WO | 96/12829 | | 5/1996 |
| WO | 2004111282 | A1 | 12/2004 |

OTHER PUBLICATIONS

Zschech, E., HTM51 (1996), p. 144. (translation of excerpt only).

Aluminiumtaschenbuch, 13. Auflage, Aluminiumverlag GmbH (1974), pp. 448-449. (translation of excerpt only).

Office Action from Japanese Application No. 2009-504569, dated Feb. 15, 2011.

* cited by examiner

METHOD FOR THE HEAT TREATMENT OF A PROFILE, DEVICE FOR THE HEAT TREATMENT OF A PROFILE AND PROFILE

BACKGROUND OF THE INVENTION

The invention first relates to a method for the heat treatment of a profile, in particular an extruded profile for aircraft. In addition, the invention relates to a device for the heat treatment of a profile, in particular an extruded profile for aircraft. Finally, the invention relates to a profile, in particular an extruded profile for aircraft.

Extruded profiles, in particular those formed with curable aluminum alloys, are extensively used in aircraft construction owing to the high mechanical loading capacity required there. The requirement for continual weight reduction is placing an ever-increasing demand on static loading capacity and other mechanical parameters of profiles made out of aluminum alloy.

For example, known treatment methods make it possible to specifically optimize extruded profiles made of curable aluminum alloys for maximum static strength or corrosion resistance. The same holds true for the achievable maximum fracture toughness of the used aluminum profiles. However, it is essentially impossible to simultaneously maximize static strength, fracture toughness and corrosion resistance, since each of these material properties can only be optimized to a theoretical maximum at the expense of at least one other material property. For example, this means that an extruded profile made of a curable aluminum alloy either exhibits a very high static strength, or reveals very favorable properties with regard to corrosion resistance and/or fracture toughness. Known treatment methods can generally not be used to optimize a profile relative to its material properties in such a way that both static strength and corrosion resistance and fracture toughness achieve the advantageous values to be realized during the isolated optimization of the profile for a single parameter.

This is because known methods involve subjecting the extruded profiles made of curable aluminum alloys to essentially the same treatment steps, so that they exhibit roughly identical material properties throughout, regardless of region. As a consequence, an aluminum profile cannot automatically be specifically optimized by region with respect to static strength, fracture toughness and corrosion resistance using the known methods.

SUMMARY OF THE INVENTION

The object of the invention is to provide a method and device for regionally optimizing several mechanical parameters of a profile, in particular an extruded profile for aircraft. Another object of the invention is to provide a profile, in particular an extruded profile, which exhibits different mechanical properties optimized in at least two respective regions. These mechanical properties relate in particular to static strength, fracture toughness and corrosion resistance.

This object is achieved by a method including subjecting at least two regions of a profile to a different heat treatment; a device with first and second chambers, in which each chamber envelops a respective region of the profile and in which different temperatures can be established in each chamber; and by a profile with at least two regions each having respectively varying material properties formed through differential heat treatment.

Because at least two regions of the profile are subjected to different heat treatments according to claim 1, varying material properties can be generated and optimized in these areas, especially with respect to static strength, corrosion resistance and fracture toughness.

In this case, the method according to the invention can be used for regionally optimizing varying material properties of profiles, in particular extruded profiles for aircraft, which are made of aluminum alloy throughout. As an alternative, the method can also be used for optimizing profiles made of two or more different aluminum alloys. For example, such profiles can be manufactured with a coextrusion method using a molding comprised of two different aluminum alloys.

According to one embodiment, a first chamber encompasses a first region of the profile, while a second chamber encompasses a second region of the profile, wherein different temperatures can be set in the first and second chambers, which makes it possible to generate and optimize varying material properties in the mentioned regions.

According to another embodiment, the profile exhibits at least two regions that are formed via differential heat treatment and exhibit varying material properties, which makes it possible to utilize the profile according to the invention for applications where the profile must simultaneously satisfy different requirements, for example with respect to static strength, fracture toughness and corrosion resistance. In this case, the profile preferably at least regionally exhibits varying, separately optimized material properties.

In another advantageous embodiment of the invention, the profile is made of an aluminum alloy, in particular a curable AlznCu alloy. Even when using a profile, in particular an extruded profile for aircraft, that consists only of an aluminum alloy throughout, this makes it possible to create regions with varying material properties, for example with respect to static strength, fracture toughness and corrosion resistance. At the same time, the profile exhibits regionally optimized material properties.

In another advantageous embodiment of the invention, the profile is made of at least two different, in particular curable aluminum alloys. By additionally using at least two aluminum alloys with different compositions to make a profile, regions inside the profile can be created or optimized in conjunction with differential heat treatment, which differ even more from each other with respect to their material properties, for example mechanical strength, fracture toughness or corrosion resistance.

The method according to the invention enables the advantageous treatment of aluminum profiles with curable aluminum alloys, which are used, for example, as frames for reinforcement purposes in fuselage cells of aircraft. In a first region of the frame formed by the profile oriented toward the outer skin of the fuselage cell (outer belt), the profile is subjected to a heat treatment based on the method according to the invention that is suitable to produce the high static strength desired in this region to the detriment of the fracture toughness and/or corrosion resistance.

By contrast, the method according to the invention can be used in a second region of the profile oriented toward the interior of the fuselage cell (inner belt) to subject the profile to another suitable heat treatment that enables a high corrosion resistance and/or fracture toughness given a simultaneously lower static strength. As a result, the properties of the aluminum profile desired in the region of the inner belt of the frame can be specifically set and optimized, at least within the limits prescribed by the alloy.

Hence, the method according to the invention enables the simple and cost-effective preparation of aluminum profiles that exhibit varying material properties that normally at least partially preclude each other in different regions. The method according to the invention allows the use in particular of extruded profiles made of aluminum alloys for applications with the most varied material requirements, wherein the profiles can be made with only a single alloy throughout.

Another example for the advantageous use of the method according to the invention involves extruded profiles with aluminum alloys, which are used in aircraft to secure seats or seat rows (seat rails), for example. The lower regions of such aluminum profiles are used to form the cabin floor, and must hence exhibit a high static strength, since they are an integral part of the entire fuselage cell statics, and have to absorb significant forces. By contrast, the upper sides of the aluminum profile, which accommodate the seats or seat rows, among other things, must exhibit in particular a high corrosion resistance and fracture toughness. The method according to the invention now makes it possible to treat the extruded profile made of a curable aluminum alloy in such a way that these varying requirements on the material in different regions of the seat rail can be satisfied with one and the same extruded profile. This yields a significant cost and weight savings.

The method according to the invention is here not limited to the use of profiles consisting of an aluminum alloy throughout.

As an alternative, for example, the extruded profile for the seat rails can also be fabricated using two different aluminum alloys in an extrusion process. This can be accomplished by the so-called coextrusion process, for example, in which a molding comprised of two different aluminum alloys is pressed through a die with a hole geometry roughly corresponding to the cross sectional geometry of the respective profile. For example, this makes it possible to use a curable aluminum alloy having a high corrosion resistance for the upper region of the seat rail. A curable aluminum alloy having another composition and high static strength values can be used for the lower region. The differential heat treatment method according to the invention then makes it possible to then optimize these varying alloy regions even further with respect to the desired material properties.

The other claims describe further advantageous embodiments of the invention.

DETAILED DESCRIPTION OF THE INVENTION

Figure 1:
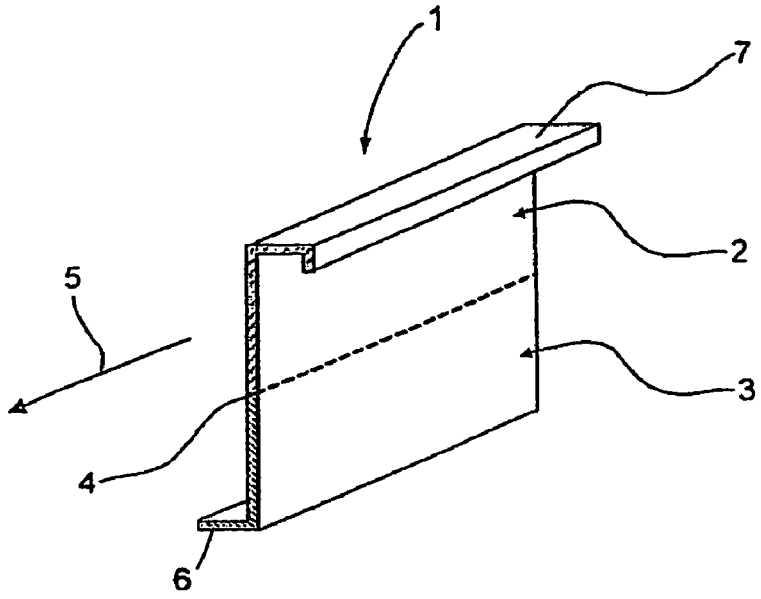
FIG. 1 shows a cross sectional view through a profile that consists of a curable aluminum alloy and was subjected to differential heat treatment using the method according to the invention.

FIG. 1 shows a cross sectional view through a profile subjected to differential heat treatment using the method according to the invention. In particular, the profile 1 is an extruded profile for aircraft made of a curable aluminum alloy throughout. The aluminum alloy can consist of a known aluminum-zinc-copper system, for example. In a particularly preferred embodiment of the invention, the profile 1 is made using an AlMgSiCu, AlCuMg or AlZnMgCu alloy. Use can also be made of other alloy systems, in particular those curable via heat treatment. In addition, the profile 1 can also be made of an at least regional combination of the alloy systems described above. The profile 1 exhibits a first region 2 and a second region 3. The first region 2 and the second region 3 are separated by a border area 4 that runs roughly parallel to a longitudinal axis 5 in the exemplary embodiment of the profile 1 shown. The boarder area 4 runs through roughly the middle of the profile 1. The border area 4 is a transition zone, in which the varying material properties of regions 2, 3 that result from differential heat treatment at least partially merge into each other. A clean-cut separation between the regions 2, 3 in terms of the material properties is technically and physically impossible. As opposed to the image of the first region 2 and the second region 3 depicted in the exemplary embodiment, as many geometric configurations as desired are possible for regions 2, 3 and the progression of the border area 4. Further, it is not necessary for the regions 2, 3 to be arranged essentially symmetrical to the longitudinal axis 5 of the profile 1. In addition, profiles with a deviating cross sectional geometry of any kind desired can exhibit regions 2, 3 with varying material properties.

For example, the profile 1 shown on FIG. 1 is used as a round frame in aircraft construction for reinforcing the fuselage cell structure of the aircraft. The profile 1 has a leg 6 that forms a so-called "outer belt" for purposes of attachment with the fuselage cell. The leg 6 is used to establish a non-positive attachment with reinforced longitudinal sections of the fuselage cell. The opposing side of the profile 1 has an abutment surface 7 to form a so-called "inner belt". Among other things, the abutment surface 7 is used to secure additional components to the aircraft structure in the interior of the fuselage cell.

It is desirable in the area of the outer belt, i.e., in the second region 3 of the profile 1, that the latter exhibit an elevated static strength by comparison to the first region 2. However, the static strength can only be increased via the deterioration in fracture toughness and/or corrosion resistance, although this is tolerable in the region of the outer belt.

By contrast, it is desirable that a high fracture toughness and/or corrosion resistance be achieved in the area of the inner belt of the profile 1, i.e., in the first region 2. However, this preferred combination of material can only be achieved at the expense of a lower static strength.

In order to achieve the property combinations mentioned above within the profile 1, which is made of a curable aluminum alloy throughout, the first region 2 and the second region 3 are each subjected to a different heat treatment. For this reason, the profile 1 in the first region 2 exhibits a high corrosion resistance and/or fracture toughness in particular, and the second region 3 advantageously exhibits a high static strength.

As illustrated based on the example of using the profile 1 as a round frame in aircraft construction, the profile 1 according to the invention exhibits regionally varying material properties, such as static strength, fracture toughness and/or corrosion resistance. This can yield a significant weight and cost savings, because the generation of profiles with regionally varying material properties no longer absolutely requires that the consist of a combination of different materials, in particular curable aluminum alloys if varying composition. In like manner, the method can also be used for profiles comprised of varying aluminum alloys. In this case, the differences in the mechanical parameters of the composite profile owing to the varying aluminum alloys can be optimized even further via the differential temperature treatment according to the invention.

As opposed to the straight shaped embodiment shown on FIG. 1, at least sections of the profile 1 can exhibit a curved or bent geometric shape. For example, such a geometric shape is required if the profile 1 is to be used as a round frame or the like. By contrast, an essentially straight shape of the profile 1 is required during use as a seat rail or the like, for example. In addition, the profile 1 preferably has an open cross sectional geometry. In this conjunction, an open cross sectional geometry is to be regarded as a profile 1 with a cross sectional surface not enveloped on all sides.

Figure 2:
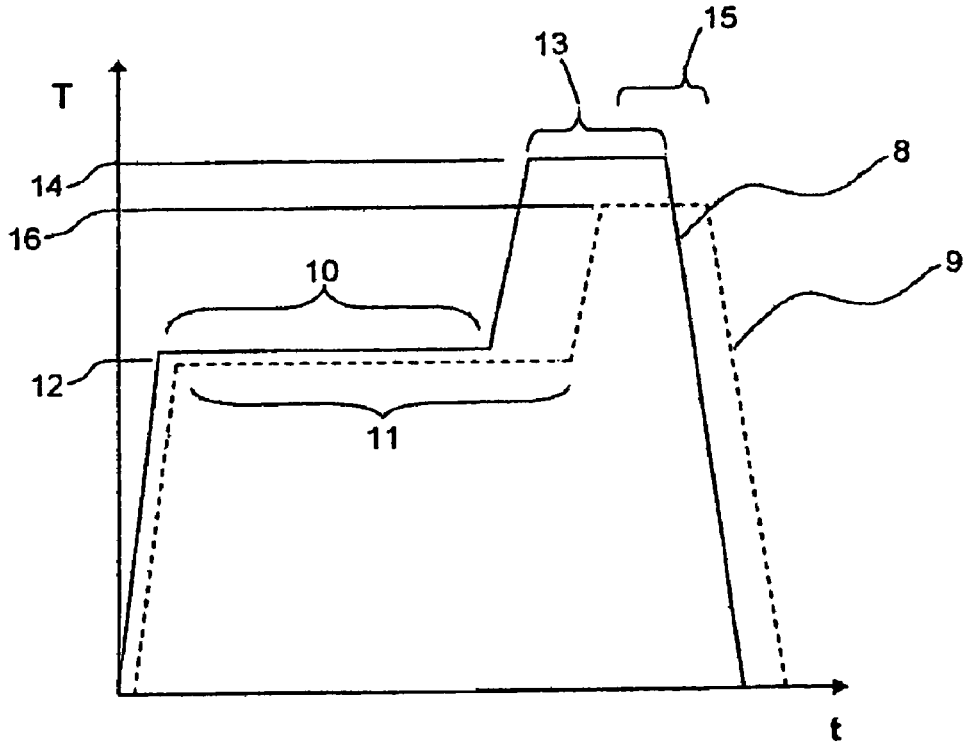
FIG. 2 shows the basic sequence of the method according to the invention as relate so an exemplary time/temperature progression.

FIG. 2 shows a time-temperature diagram that diagrammatically depicts the progression of the method according to the invention for the varying or differential heat treatment of the first and second region 2, 3 of the profile 1 based on an exemplary embodiment. It is assumed in this exemplary embodiment as well that the profile 1 consists of a curable aluminum alloy throughout.

The y-coordinate of the diagram shows the temperature used on the respective region 2, 3 of the profile, while the x-coordinate plots the time. A first temperature progression 8 over time represents the exemplary progression of temperature exposure during the differential heat treatment according to the invention in the first region 2. A second temperature progression 9 shown with a dashed line represents the respective chronological progression of temperature exposure in the second region 3. The different heat treatments take place simultaneously in the exemplary embodiment shown on FIG. 2, but can also be chronologically staggered. It must basically be noted that exposure to a higher temperature over a longer time generally improves the corrosion resistance and/or fracture toughness of the respective region, while this increase is usually accompanied by a deterioration in static strength.

During the course of two pretreatment phases 10, 11, both the first region 2 and the second region 3 are first exposed to a pretreatment temperature 12. Pre-treatment phases 10, 11 differ in terms of their duration. The pretreatment phase 11 in the exemplary embodiment shown on FIG. 2 is longer than the first pretreatment phase 10. The temperature progressions 8, 9 in the region of pretreatment phases 10, 11 are only depicted on FIG. 2 slightly shifted relative to each other in the direction of the temperature axis to provide improved graphic clarity. The pretreatment temperature 10 is roughly the same for each of the regions 2, 3.

The pretreatment phases 10, 11 are used in particular to first maximize the strength of the entire profile 1 within the limits prescribed by the alloy independently of the regions 2, 3. As opposed to the depicted exemplary embodiment on FIG. 2, a different respective pretreatment temperature 12 can be selected for the first and second regions 2, 3 at the same or varying duration of the pretreatment phases 10, 11. For example, this approach is advantageous if the profile consists of two aluminum alloys varying in composition. In an especially advantageous manner for profiles comprised of an aluminum alloy throughout, the first and the second region 2, 3 are exposed to a pretreatment temperature 12 measuring roughly 120° C. or 393 K during the pretreatment phases 10, 11 or so-called preliminary storing. Profiles consisting of at least two different aluminum alloys may require values that deviate from this depending on the alloy system used, and under certain conditions even vary regionally.

In the phase involving the actual differential heat treatment of the first and the second region 2, 3, the regions 2, 3 are each subjected to different temperature progressions 8, 9. During a first exposure period 13, the first region is subjected to a first temperature 14. The second region 3 is correspondingly exposed to a second temperature 16 during a second exposure duration 15. According to the invention, the first temperature 14 is here greater than the second temperature 16, and the first exposure duration 13 is longer than the second exposure duration 15.

In an especially preferred exemplary embodiment of the method according to the invention, a value measuring roughly 8 to 12 hours is selected for the first exposure period 13. A value ranging from about 5 to 8 hours is used for the second exposure duration 15. In this case, the first temperature 14 measures roughly 170° C. or 443 K, while a value of roughly 150° C. or 423 K is selected for the second temperature 16.

This differential heat treatment yields an elevated corrosion resistance and/or fracture toughness in particular in the first region 2 of the profile 1. By contrast, this heat treatment produces an improved static strength, in particular in the second region 3 of the profile 1. The chronological temperature progressions 8, 9 can deviate from the trapezoidal ones denoted in the diagram, and follow nearly any constant curve desired, just as long as there is a sufficient temperature difference.

Therefore, the method according to the invention makes it possible to generate respectively varying material properties in the first and second region 2, 3 of the profile 1, even though the profile 1 consists of an essentially homogenous aluminum alloy throughout. In particular, these material properties relate to static strength, fracture toughness and/or corrosion resistance.

As an alternative, the method according to the invention can also be used to differentially heat treat profiles consisting of two or more different aluminum alloys. In this case, regions composed of the same aluminum alloy are preferably also subjected to the same temperature treatment and same temperature progression. However, as an alternative, those regions of the profile composed of the same aluminum alloy can also be subjected to a differential heat treatment. The temperature ranges and exposure intervals already mentioned above might here have to be varied as a function of the different alloy systems used.

Using aluminum alloys varying in composition to generate the profile 1 enables an even more differentiated formation of the most varied of material properties, in particular with respect to static strength, fracture toughness and corrosion rate, in respectively differing regions of the profile.

Figure 3:
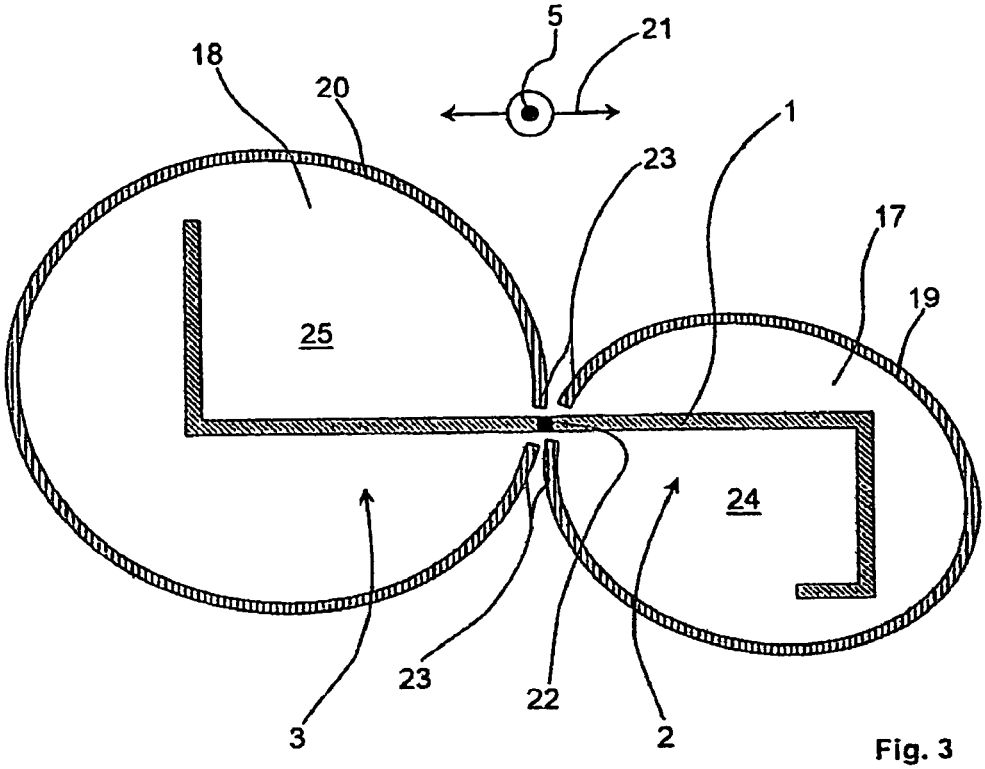
FIG. 3 shows an exemplary embodiment of a device for implementing the method according to the invention.

Finally, FIG. 3 illustrates an exemplary embodiment of a device for implementing the method according to the invention on the profile 1 with the first region 2 and the second region 3. The first region 2 is enveloped by a first chamber 17 closed on all sides, and the second region 3 is enveloped by a second chamber 18 closed an all sides, so that the first region 2 and second region 3 can each be subjected to a different, i.e., differential temperature treatment. For example, the chambers 17, 18 can be composed of long stretched out, longitudinally slotted hose-like structures, in particular in the form of heat-resistant hoses 19, 20 or the like. After a corresponding longitudinal slit has been introduced, the hoses 19, 20 are to this end pushed or pressed onto the corresponding areas 2, 3 of the profile 1 along the longitudinal axis 5 and/or in the direction of a transverse axis 21. Longitudinal edges 23 of the hoses 19, 20 come to roughly abut each other or the profile 1 in a border area 22, thereby forming a nearly complete seal between the chambers 17, 18.

A first temperature 24 can be established and maintained inside the first chamber 17, and a second temperature 25 can be established and maintained inside the second chamber 18. The set temperatures 24, 25 preferably differ. Any thermal compensation processes between the first region 2 and second region 3 due to leaks in the border area 22 and/or any heat conduction processes between the regions 2, 3 of the profile 1 can generally be disregarded given the prevailing temperature difference.

Primarily liquid and/or gaseous media are suited for heating the chambers 17, 18 as precisely as possible, e.g., hot air. The hot air is here generated with a device not shown in any greater detail, for example an electrically heatable hot-air bellows or the like. The chambers 17, 18 also incorporate temperature sensors not shown in any greater detail, so that an open- and closed-loop controller (also not depicted) can be used to keep the temperatures 24, 25 within the chambers 17, 18 as close to the values prescribed by the temperature progressions 8, 9. The open- and closed-loop controller can here be designed as a known computer, for example.

Sealing means not shown in any greater detail in the depiction on FIG. 3 can also be provided on the longitudinal edges 23 of the hoses 19, 20 so as to further improve the sealing effect between the first chamber 17 and the second chamber 18, as well as the profile 1. The sealing means can take the form of sealing lips, for example, which are introduced by flattening areas on the hoses 19, 20 in proximity to the longitudinal edges 23. As an alternative, separate sealing means can also be positioned in the area of the longitudinal edges 23.

In order to treat the profile 1 or implement the method according to the invention, the profile 1, the prescribed chronological temperature progressions 8, 9 keep the profile 1 inside the device for a total of up to 12 hours, plus the duration of the pretreatment phases 10, 11.

In an alternative embodiment of the device, the hoses 19, 20 can be interconnected along the longitudinal edges 23 below or above the profile 1. In this embodiment, the hoses 19, 20 can be detached and reattached in the area of the outer longitudinal edges, ensuring that they can be attached to the profile 1.

Figure 4:
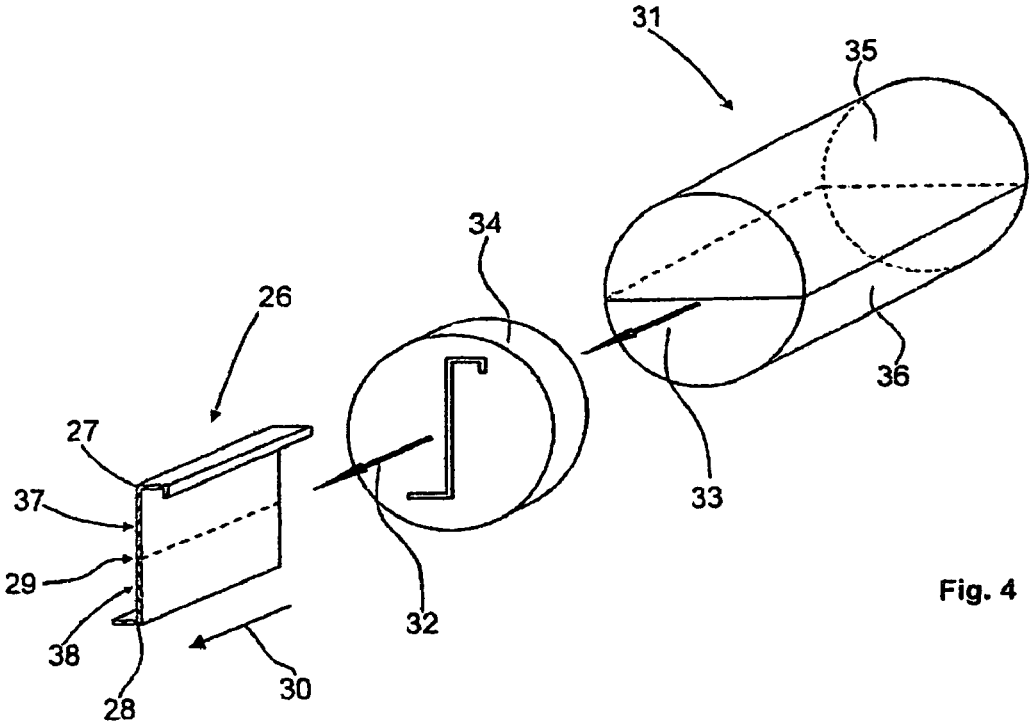
FIG. 4 shows a diagrammatic view of the manufacture of a profile consisting of two different aluminum alloys.

FIG. 4 shows an exemplary embodiment of a profile 26 consisting of a first and second alloy region 27, 28, wherein the alloy regions 27, 28 are each comprised of curable aluminum alloys varying in composition. The alloy regions 27, 28 abut each other in a border area 29. Both alloys become at least partially intermixed in the border area 29, so that the material properties are at least partially mixed in this region. The border area 29 runs roughly parallel to a longitudinal axis 30.

For example, in the exemplary embodiment shown, the profile 26 is fabricated by pressing a cylindrical molding 31 through a die 34 under a high pressure in the direction of arrows 32, 33. The opening geometry of the die 34 roughly corresponds to the cross sectional geometry of the profile 26 to be compression molded. The molding 31 is comprised of half-cylinders 35, 36 lying one atop the other. The high pressure prevailing inside the die 34 generates a rigid attachment between the alloy regions 27, 28 in the border area 29 in the arising profile 26. The half-cylinders 34, 35 here each consist of aluminum alloys varying in composition, so that the alloy regions 27, 28 each exhibit correspondingly different material properties. The mentioned material properties refer in particular to mechanical strength, fracture toughness, corrosion resistance and the thermal joinability of the profile 26. Materials used in creating the half-cylinders 35, 36 include in particular curable aluminum alloys such as AlMgSiCu, AlCuMg and AlZnMgCu systems.

As an alternative, the profile 26 can also be formed by joining already extruded partial profiles composed of different aluminum alloys using known joining procedures, e.g., welding, friction/agitation welding or the like.

Profile 26 is subsequently subjected to a differential heat treatment pursuant to the method described further above, or to a treatment in the device already described. Regions composed of the same aluminum alloy are here preferably also subjected to the same temperature treatment. In the exemplary embodiment depicted on FIG. 4, this means that the alloy regions 27, 28 simultaneously form a first and a second region 37, 38 corresponding to those regions 2, 3 which, as already described above, were subjected to a differential heat treatment based on temperature progressions 8, 9 and using the method according to the invention (see in particular FIG. 1 and 2).

However, as an alternative, regions composed of the same respective aluminum alloys can also be subjected to a varying or differential temperature treatment. In this case, the regions 27, 37 or 28, 38 are no (longer) completely coincident.

Either in combination with the method according to the invention or in and of itself, using profiles 1, 26 consisting of at least two aluminum alloys varying in composition enables the formation of material properties that differ locally to an even greater extent than would be the case using profiles composed of only a single aluminum alloy. Finally, more than two different aluminum alloys can also be used to generate the profile 26.

REFERENCE LIST

| | |
|---|---|
| 1 | Profile |
| 2 | First region |
| 3 | Second region |
| 4 | Border area |
| 5 | Longitudinal axis |
| 6 | Leg |
| 7 | Abutment surface |
| 8 | First temperature progression |
| 9 | Second temperature progression |
| 10 | First pretreatment phase |
| 11 | Second pretreatment phase |
| 12 | Pretreatment temperature |
| 13 | First exposure period |
| 14 | First temperature |
| 15 | Second exposure period |
| 16 | Second temperature |
| 17 | First chamber |
| 18 | Second chamber |
| 19 | Hose |
| 20 | Hose |
| 21 | Transverse axis |
| 22 | Border area |
| 23 | Longitudinal edge |
| 24 | First temperature |
| 25 | Second temperature |
| 26 | Profile |
| 27 | First alloy region |
| 28 | Second alloy region |
| 29 | Border area |
| 30 | Longitudinal axis |
| 31 | Molding |
| 32 | Arrow |
| 33 | Arrow |
| 34 | Die |
| 35 | Half-cylinder |
| 36 | Half-cylinder |
| 37 | First region |
| 38 | Second region |

The invention claimed is:

1. A device for heat treating an extruded profile for aircraft, the device comprising:

a first heating chamber; and a second heating chamber;

wherein the first heating chamber envelops a first region of the profile, and wherein the second heating chamber envelops a second region of the profile, wherein a first and a second temperatures can be established in the first and second heating chambers, respectively;

wherein the first and second heating chambers are formed by longitudinally slit heat-resistant hoses;

wherein the second temperature measures at least 120° C. or 393 K; and wherein the first temperature is greater than the second temperature.

2. The device according to claim 1, wherein the first and second chambers are heated by a gas;

wherein the hot gas is generated by an electrically heatable device.

3. The device according to claim 1, wherein the longitudinally slit hoses are securable onto the profile, which is made from two aluminum alloys, along a longitudinal axis of the profile and/or parallel to a transverse axis of the profile to create self-contained first and second heating chambers;

wherein the first heating chamber is adapted to heat the first region of the profile that is formed with a first AlCuMg alloy and the second heating chamber is adapted to heat the second region of the profile that is formed of a second AlZnMg alloy.

4. The device according to claim 1, wherein longitudinal edges of the first and second heating chambers roughly abut each other in a border area between the first and second regions, so as to achieve a differential heat treatment in the first and second regions.

5. A device for heat treating an extruded profile for aircraft, the device comprising:

a first heating chamber; and a second heating chamber;

wherein the first heating chamber envelops a first region of the profile, and wherein the second heating chamber envelops a second region of the profile, wherein a first and a second temperatures can be established in the first and second heating chambers, respectively;

wherein the first and second heating chambers are formed by longitudinally slit heat-resistant hoses;

wherein the first and second heating chambers are heated by a hot gas;

wherein the hot gas is generated by an electrically heatable device.

6. The device according to claim 5, wherein the longitudinally slit hoses are securable onto the profile, which is made from two aluminum alloys, along a longitudinal axis of the profile and/or parallel to a transverse axis of the profile to create the self-contained first and second heating chambers;

wherein the first heating chamber is adapted to heat the first region of the profile that is formed with a first AlCuMg alloy and the second heating chamber is adapted to heat the second region of the profile that is formed of a second AlZnMg alloy.

7. The device according to claim 5, wherein longitudinal edges of the first and second heating chambers roughly abut each other in a border area between the first and second regions, so as to achieve a differential heat treatment in the first and second regions.

* * * * *